US007485254B2

(12) United States Patent
Nakabayashi et al.

(10) Patent No.: US 7,485,254 B2
(45) Date of Patent: Feb. 3, 2009

(54) METAL POWDER PRODUCTION APPARATUS

(75) Inventors: Koei Nakabayashi, Hachinohe (JP); Mitsutoyo Tanaka, Chino (JP); Tokihiro Shimura, Hachinohe (JP); Yoshinari Tanaka, Hachinohe (JP)

(73) Assignee: Seiko Epson Corporation (JP)

( * ) Notice: Subject to any disclaimer, the term of this patent is extended or adjusted under 35 U.S.C. 154(b) by 234 days.

(21) Appl. No.: 11/641,428

(22) Filed: Dec. 19, 2006

(65) Prior Publication Data

US 2007/0138712 A1 Jun. 21, 2007

(30) Foreign Application Priority Data

Dec. 20, 2005 (JP) ..... 2005-367229

(51) Int. Cl.
*C21C 1/00* (2006.01)
*B22F 9/06* (2006.01)

(52) U.S. Cl. ..... 266/202; 75/343

(58) Field of Classification Search ..... 266/202; 251/11, 342; 72/342.5, 342.6
See application file for complete search history.

(56) References Cited

U.S. PATENT DOCUMENTS 4,624,409 A * 11/1986 Takeda et al. ..... 239/11
5,289,975 A 3/1994 Miller et al.
5,366,204 A 11/1994 Gigliotti, Jr. et al.
5,656,061 A 8/1997 Miller et al.

FOREIGN PATENT DOCUMENTS

GB 2 155 048 9/1985
JP B-03-55522 8/1991

OTHER PUBLICATIONS

Search Report issued in corresponding European application.

* cited by examiner

*Primary Examiner*—Jennifer McNeil
*Assistant Examiner*—James Corno
(74) *Attorney, Agent, or Firm*—Harness, Dickey & Pierce, P.L.C.

(57) ABSTRACT

A metal powder production apparatus includes a supply part for supplying molten metal and a nozzle having a first member and a second member by which an orifice for injecting water is defined. The first member has a gradually reducing inner diameter portion. A heat insulating layer for cutting off radiant heat emitted from the molten metal is formed on the gradually reducing inner diameter portion of the first member. the nozzle is configured to ensure that the gradually reducing inner diameter portion is prevented, under an action of the heat insulating layer, from being thermally deformed by the radiant heat of the molten metal but a region of the first member near the orifice is thermally deformed in such a direction as to reduce a size of the orifice by absorbing the radiant heat of the molten metal, whereby the orifice can be restrained from being enlarged by the pressure of the water passing through the orifice.

12 Claims, 3 Drawing Sheets

METAL POWDER PRODUCTION APPARATUS

CROSS-REFERENCE TO RELATED APPLICATION

This application claims a priority to Japanese Patent Application No. 2005-367229 filed on Dec. 20, 2005 which is hereby expressly incorporated by reference herein in its entirety.

BACKGROUND

1. Technical Field

The present invention relates to a metal powder production apparatus for producing metal powder from molten metal.

2. Related Art

Conventionally, a metal powder production apparatus (atomizer) that pulverizes molten metal into metal powder by an atomizing method has been used in producing metal powder. Examples of the metal powder production apparatus known in the art include a molten metal atomizing and pulverizing apparatus disclosed in JP-B-3-55522.

The molten metal atomizing and pulverizing apparatus is provided with a molten bath nozzle for ejecting molten bath (molten metal) in a downward direction and a water nozzle having a flow path through which the molten bath ejected from the molten bath nozzle passes and a slit opened into the flow path. Water is injected from the slit of the water nozzle.

The apparatus of the prior art mentioned above is designed to produce metal powder by bringing the molten bath passing through the flow path into collision with the water injected from the slit to thereby disperse the molten bath in the form of a multiplicity of fine liquid droplets and then allowing the multiplicity of fine liquid droplets to be cooled and solidified.

However, in the apparatus of the prior art mentioned above, the clearance of the slit is excessively enlarged by the pressure of the water flowing therethrough. As a result, water pressure is dropped in the water nozzle. This water pressure drop causes a problem of overly reducing the flow velocity of the water injected from the slit. Therefore, since the ability for the fast-flowing water to pulverize the molten bath is decreased, fine-sizing of the metal powder cannot be made. This makes it difficult to obtain fine powder of a desired particle size.

SUMMARY

Accordingly, it is an object of the present invention to provide a metal powder production apparatus capable of maintaining a flow velocity of fluid injected from an orifice nearly constant in a reliable manner.

One aspect of the invention is directed to a metal powder production apparatus. The metal powder production apparatus comprises a supply part for supplying molten metal and a nozzle provided below the supply part. The nozzle includes a flow path defined by an inner circumferential surface of the nozzle through which the molten metal supplied from the supply part can pass, the inner circumferential surface of the nozzle having a gradually reducing inner diameter portion whose inner diameter is gradually reduced in a downward direction, an orifice opened at a bottom end of the flow path and adapted to inject fluid toward the flow path, a retention portion for temporarily retaining the fluid, and an introduction path for introducing the fluid from the retention portion to the orifice.

The molten metal is dispersed and turned into a multiplicity of fine liquid droplets by bringing the molten metal passing through the flow path into contact with the fluid injected from the orifice of the nozzle, so that the multiplicity of fine liquid droplets are solidified to thereby produce metal powder.

Further, the nozzle includes a first member having the gradually reducing inner diameter portion and a second member provided below the first member with a space left between the first member and the second member. The orifice, the retention portion and the introduction path are defined by the first member and the second member.

The metal powder production apparatus further comprises a heat insulating means for cutting off radiant heat emitted from the molten metal passing through the flow path, the heat insulating means being provided on or in the first member so that the gradually reducing inner diameter portion is prevented, under an action of the heat insulating means, from being thermally deformed by the radiant heat of the molten metal but a region of the first member near the orifice is thermally deformed in such a direction as to reduce a size of the orifice by absorbing the radiant heat of the molten metal, whereby the orifice can be restrained from being enlarged by the pressure of the fluid passing through the orifice.

According to the above metal powder production apparatus, since the gradually reducing inner diameter portion of the first member is thermally insulated by the heat insulating means and the region of the first member near the orifice absorbs the radiant heat of the molten metal, the region of the first member near the orifice is preferentially or selectively thermally deformed in such a direction as to reduce the size of the orifice. As a result, the orifice is prevented from being enlarged by the pressure of the fluid passing through the orifice. This makes it possible to maintain the flow velocity of the fluid injected from the orifice nearly constant in a reliable manner.

It is preferred that the heat insulating means includes a heat insulating layer for cutting off radiant heat emitted from the molten metal passing through the flow path, the heat insulating layer formed on the gradually reducing inner diameter portion of the first member.

This makes it possible to maintain the flow velocity of the fluid injected from the orifice nearly constant in more reliable manner.

It is preferred that the heat insulating layer is mainly composed of ceramics.

This makes it possible to reliably cut off the radiant heat which would otherwise be applied to the region of the first member which excludes the region of the first member near the discharge port of the orifice.

It is preferred that the heat insulating means includes a pipe-shaped heat insulating member for cutting off radiant heat emitted from the molten metal passing through the flow path, the heat insulating member provided at the inner side of the gradually reducing inner diameter portion of the first member.

This makes it possible to maintain the flow velocity of the fluid injected from the orifice nearly constant in more reliable manner.

It is preferred that the heat insulating means includes a cooling means for cooling down a cooling means for cooling down a region of the first member which excludes a region of the first member adjacent to the opening of the orifice.

This makes it possible to maintain the flow velocity of the fluid injected from the orifice nearly constant in more reliable manner.

It is preferred that the cooling means is embedded in the first member.

This makes it possible to maintain the flow velocity of the fluid injected from the orifice nearly constant in more reliable manner.

It is preferred that the cooling means is positioned above the introduction path.

This ensures that the cooling means is sufficiently spaced apart from the region of the first member near the orifice, thereby reliably preventing that region from being cooled down by the cooling means.

It is preferred that the orifice is opened in a circumferential slit shape extending over the inner circumferential surface of the nozzle.

This ensures that the fluid is injected in a generally conical contour with an apex thereof lying definitely at the lower side.

It is preferred that the orifice has an inner circumferential surface defined by the first member and an outer circumferential surface defined by the second member.

This makes it possible to easily and reliably form the orifice. Furthermore, the size of the orifice can be properly set in accordance with the size of the space left between the first member and the second member.

It is preferred that the orifice is configured to ensure that the fluid is injected in a generally conical contour with an apex lying at a lower side.

This ensures that the molten metal is dispersed within the fluid injected in a generally conical contour and is turned to a multiplicity of fine liquid droplets in a reliable manner.

It is preferred that the introduction path has a vertical cross-section of a wedge shape.

This makes it possible to gradually increase the flow velocity of the fluid. It is also possible to stably inject the fluid having an increased velocity from the orifice.

It is preferred that the gradually reducing inner diameter portion is of a convergent shape.

This ensures that the air subsisting above the nozzle flows into (or is sucked up into) the gradually reducing inner diameter portion together with the stream of fluid injected from an orifice. The air thus introduced exhibits a greatest flow velocity near a smallest inner diameter section of the gradually reducing inner diameter portion. Under an action of the air whose flow velocity has become greatest, the molten metal is dispersed and turned to a multiplicity of fine liquid droplets in a reliable manner.

The above and other objects, features and advantages of the present invention will become apparent from the following description of preferred embodiments given in conjunction with the accompanying drawings.

DESCRIPTION OF EXEMPLARY EMBODIMENTS

Hereinafter, a metal powder production apparatus in accordance with the present invention will be described in respect of preferred embodiments shown in the accompanying drawings.

First Embodiment

Figure 1:
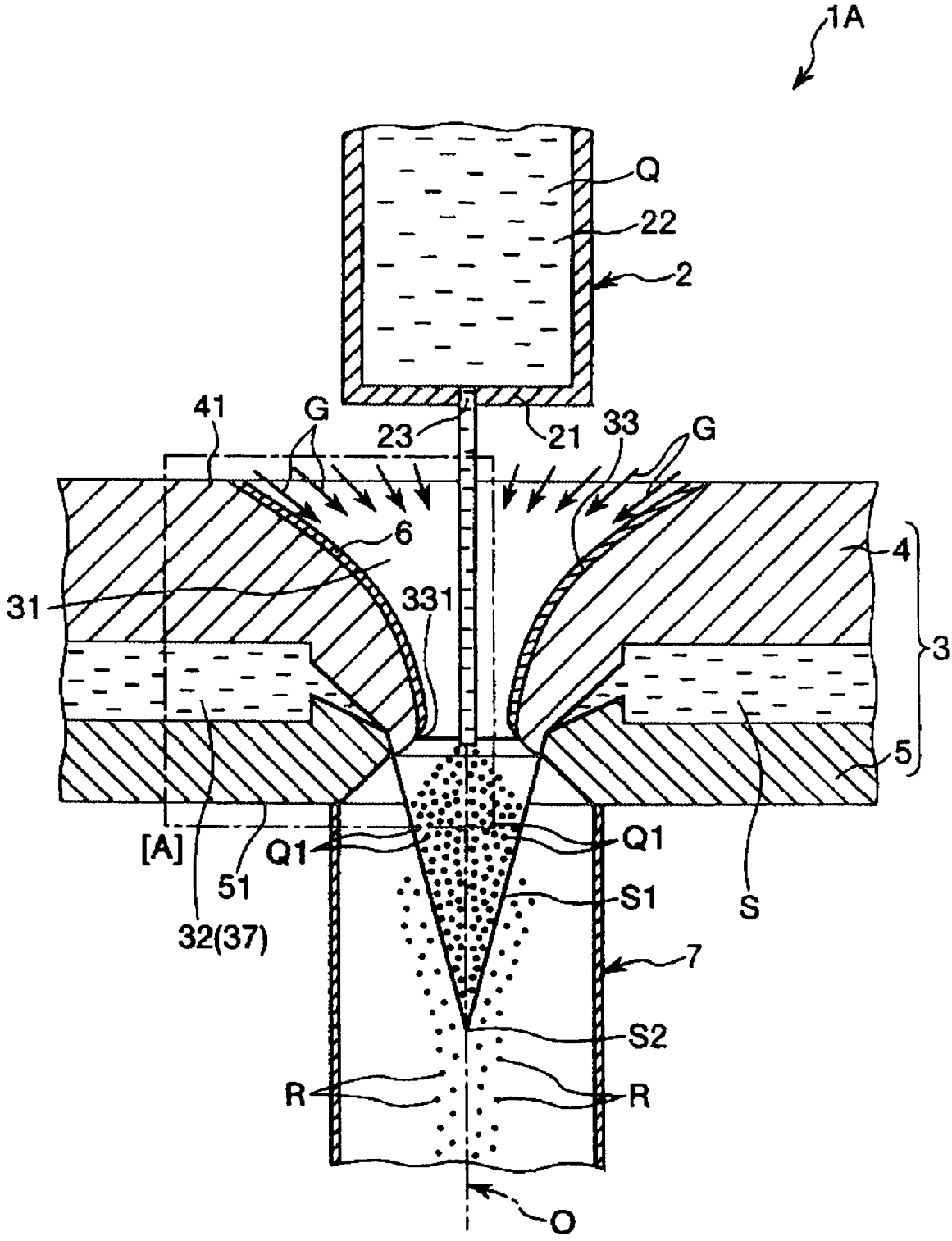
FIG. 1 is a vertical sectional view showing a metal powder production apparatus in accordance with a first embodiment of the present invention.
Figure 2:
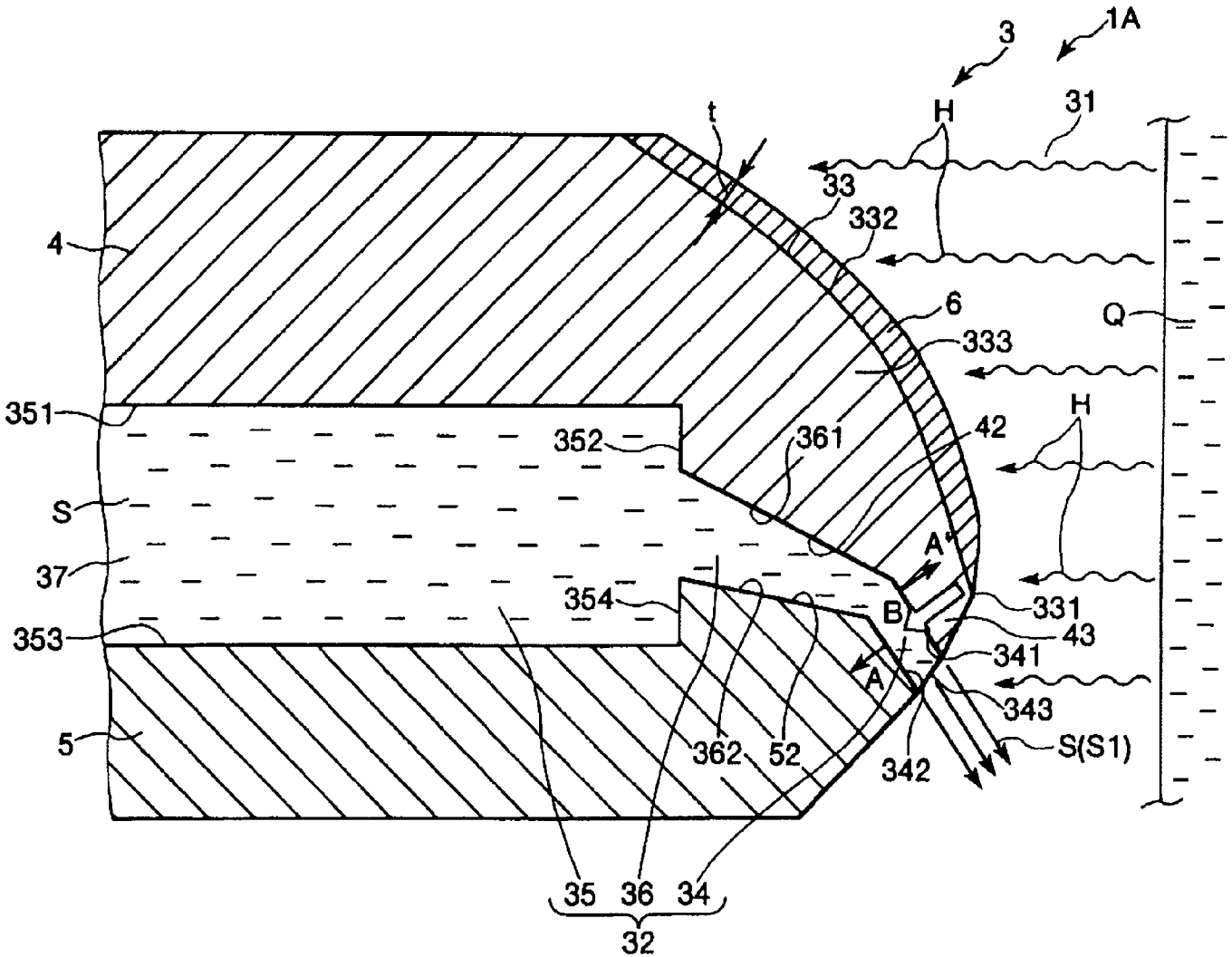
FIG. 2 is an enlarged detail view of a region [A] enclosed by a single-dotted chain line in FIG. 1.

FIG. 1 is a vertical sectional view showing a metal powder production apparatus in accordance with a first embodiment of the present invention, FIG. 2 is an enlarged detail view of a region [A] enclosed by a single-dotted chain line in FIG. 1.

In the following description, the upper side in FIGS. 1 and 2 will be referred to as "top" or "upper" and the lower side will be referred to as "bottom" or "lower", only for the sake of better understanding.

The metal powder production apparatus (atomizer) 1A shown in FIG. 1 is an apparatus that pulverizes molten metal Q by an atomizing method to obtain a multiplicity of metal powder particles R. The metal powder production apparatus 1A includes a supply part 2 for supplying the molten metal Q, a nozzle 3 provided below the supply part 2, a heat insulating layer (heat insulating means) 6 formed on the nozzle 3 (namely, the first member 4), and a cover 7 attached to a bottom end surface 51 of the nozzle 3 (namely, the second member 5).

Taken as an example in the present embodiment is a case that the metal powder production apparatus 1A produces metal powder particles R made of stainless steel (e.g., 304L, 316L, 17-4PH, 440C or the like) or Fe—Si-based magnetic material.

Now, description will be given to the configuration of individual parts.

As shown in FIG. 1, the supply part 2 has a portion of a bottom-closed tubular shape. In an internal space (cavity portion) 22 of the supply part 2, there is temporarily stored the molten metal Q (a molten material) obtained by mixing a simple substance of Co and a simple substance of Sn at a predetermined mol ratio (e.g., a mol ratio of 1:2) and melting them.

Furthermore, an ejection port 23 is formed at the center of a bottom portion 21 of the supply part 2. The molten metal Q in the internal space 22 is downwardly ejected from the ejection port 23.

The nozzle 3 is arranged below the supply part 2. The nozzle 3 is provided with a first flow path 31 through which the molten metal Q supplied (ejected) from the supply part 2 passes and a second flow path 32 through which water S supplied from a water source (not shown) for supplying fluid (water or liquid S in the present embodiment) passes.

The first flow path 31 has a circular cross-section and extends in a vertical direction at the center of the nozzle 3. The first flow path 31 is defined by an inner circumferential surface of the nozzle 3. The inner circumferential surface of the nozzle 3 has a gradually reducing inner diameter portion 33 of a convergent shape whose inner diameter is gradually decreased from a top end surface 41 of the nozzle 3 toward the bottom thereof. Specifically a first member 4 which will be described hereinafter has the gradually reducing inner diameter portion 33.

Thus, the air (gas) G subsisting above the nozzle 3 flows into (or is sucked up into) the gradually reducing inner diameter portion 33 (the first flow path 31) together with the stream of water (fluid) S injected from an orifice 34, which will be describe later. The air G thus introduced exhibits a greatest flow velocity near a smallest inner diameter section 331 of the gradually reducing inner diameter portion 33 (near a section at which the orifice 34 is opened). Under an action of the air G whose flow velocity has become greatest, the molten metal Q is dispersed and turned to a multiplicity of fine liquid droplets Q1 in a reliable manner.

As illustrated in FIG. 2, the second flow path 32 is formed of an orifice 34 opened toward a bottom end portion (the vicinity of the smallest inner diameter section 331) of the first flow path 31, a retention portion 35 for temporarily retaining the water S, and an introduction path (interconnecting path) 36 through which the water S is introduced from the retention portion 35 into the orifice 34.

The retention portion 35 is connected to the water source to receive the water S therefrom. The retention portion 35 communicates with the orifice 34 through the introduction path 36. Furthermore, the retention portion 35 has a vertical cross-section of a rectangular (or square) shape.

The introduction path 36 is a region whose vertical cross-section is of a wedge-like shape. This makes it possible to gradually increase the flow velocity of the water S flowing into the introduction path 36 from the retention portion 35 and, hence, to stably inject the water S with an increased flow velocity from the orifice 34.

The orifice 34 is a region at which the water S passed the retention portion 35 and the introduction path 36 in sequence is injected or spouted into the first flow path 31.

The orifice 34 is opened in a circumferential slit shape extending over the inner circumferential surface of the nozzle 3. Furthermore, the orifice 34 is opened in an inclined direction with respect to a center axis O of the first flow path 31.

By virtue of the orifice 34 formed in this manner, the water S is injected as a liquid jet S1 of a generally conical contour with an apex S2 thereof lying definitely at the lower side (see FIG. 1). This ensures that, in and inside the liquid jet S1, the molten metal Q is dispersed and turned to the multiplicity of fine liquid droplets Q1 in a reliable manner.

As set forth above, the molten metal Q is further dispersed and turned to the multiplicity of fine liquid droplets Q1 in a reliable manner, by the Air G whose flow velocity becomes greatest near the smallest inner diameter section 331 of the gradually reducing inner diameter portion 33. This generates a synergistic effect by which the molten metal Q is reliably dispersed and turned to the multiplicity of fine liquid droplets Q1 in more reliable manner.

The molten metal Q turned to the multiplicity of liquid droplets Q1 is cooled and solidified by making contact with the liquid jet S1, whereby a multiplicity of metal powder particles R are produced. The multiplicity of metal powder particles R thus produced are received in a container (not shown) arranged below the metal powder production apparatus 1A.

The nozzle 3 in which the first flow path 31 and the second flow path 32 are formed includes a first member 4 of a disk-like shape (ring-like shape) and a second member 5 of a disk-like shape (ring-like shape) arranged concentrically with the first member 4 (see FIGS. 1 and 2). The second member 5 is arranged below the first member 4 with a space 37 left therebetween.

The orifice 34, the introduction path 36 and the retention portion 35 are respectively defined by the first member 4 and the second member 5 arranged in this way. That is to say, the second flow path 32 is provided by the space 37 formed between the first member 4 and the second member 5.

As illustrated in FIG. 2, the orifice 34 has an inner circumferential surface 341 defined by a bottom portion 42 of the first member 4 and an outer circumferential surface 342 defined by a top portion 52 of the second member 5.

Likewise, the introduction path 36 has an upper surface 361 defined by the bottom portion 42 of the first member 4 and a lower surface 362 defined by the top portion 52 of the second member 5.

Moreover, the retention portion 35 has an upper surface 351 and an inner circumferential surface 352 lying above the introduction path 36, both of which are defined by the bottom portion 42 of the first member 4, and a lower surface 353 and an inner circumferential surface 354 lying below the introduction path 36, both of which are defined by the top portion 52 of the second member 5.

By defining the orifice 34, the introduction path 36 and the retention portion 35 in this manner, it is possible to easily and reliably form the orifice 34, the introduction path 36 and the retention portion 35 in the nozzle 3. Furthermore, the size of the orifice 34, the introduction path 36 and the retention portion 35 can be properly set in accordance with the size of the space 37.

Examples of a constituent material of the first member 4 and the second member 5 include, but are not particularly limited to, a variety of metallic materials. In particular, use of stainless steel is preferred, and use of Cr-based stainless steel or precipitation hardening stainless steel is more preferred.

As shown in FIG. 1, the cover 7 formed of a tubular body is fixedly secured to a bottom end surface 51 of the second member 5. The cover 7 is arranged concentrically with the first flow path 31. Use of the cover 7 makes it possible to prevent the metal powder particles R from flying apart as they fall down, whereby the metal powder particles R can be reliably received the container.

As illustrated in FIG. 2 (also in FIG. 1), the heat insulating layer (heat insulating means) 6 is formed on (bonded to) the gradually reducing inner diameter portion 33 of the first member 4.

The heat insulating layer 6 is formed with a uniform thickness "t" on the gradually reducing inner diameter portion 33 and extends over the entire circumference of the gradually reducing inner diameter portion 33.

Such a heat insulating layer 6 is adapted to insulate a region 333 of the first member 4 which excludes a region of the first member 4 adjacent to a discharge port (opening) 343 of the orifice 34 from the radiant heat H emitted by the molten metal Q passing through the first flow path 31. This makes it possible to reliably prevent thermal deformation (thermal expansion) of the region 333 of the first member 4 which would otherwise occur by the radiant heat H of the molten metal Q.

With the metal powder production apparatus 1A of the configuration noted above, as the water S is injected from the orifice 34, the inner circumferential surface 341 and the outer circumferential surface 342 are pushed in such directions as to move away from each other, i.e., in the directions indicated by arrows "A" and "A'" in FIG. 2 (also in FIG. 3), by the pressure of the water S passing through the orifice 34. As a result, the orifice 34 is urged to become enlarged.

However, since the region 333 of the first member 4 is thermally insulated and prevented from thermal deformation as set forth above, the region of the first member 4 adjacent to the orifice 34 (hereinafter referred to as a "region 43 of the first member 4") absorbs the radiant heat H of the molten metal Q. Thus, the region 43 of the first member 4 is preferentially or selectively displaced (thermally deformed) in such a direction as to reduce the size of the orifice 34, i.e., in the direction indicated by an arrow "B" in FIG. 2 (also in FIG. 3). The displacement of the region 43 of the first member 4 in the arrow "B" direction is cancelled by the displacement of the outer circumferential surface 342 in the arrow "A'" direction, thereby restraining enlargement of the orifice 34.

Thus, it is possible to maintain the size of the orifice 34 constant, whereby the flow velocity of the water S injected from the orifice 34 can be kept constant in a reliable manner.

Preferably, the heat insulating layer 6 is mainly composed of, e.g., ceramics, although not particularly limited thereto. This enables the region 333 of the first member 4 to be reliably insulated from the radiant heat H.

Although the heat insulating layer 6 is formed on the gradually reducing inner diameter portion 33 over the entire circumference thereof, the present invention is not limited thereto. Alternatively, a plurality of heat insulating layer parts may be provided on the gradually reducing inner diameter portion 33 with a predetermined spacing in the circumferential direction thereof.

Furthermore, although the heat insulating layer 6 is formed on the gradually reducing inner diameter portion 33, namely the region 333 of the first member 4 which excludes the region 42 of the first member 4, the present invention is not limited thereto.

Alternatively, the heat insulating layer 6 may be formed on the entirety of the inner circumferential surface 332 of the first member 4 (the region 333 and the region 42 of the first member 4). In case the heat insulating layer 6 is formed on the entirety of the inner circumferential surface 332 of the first member 4, the nozzle 3 is prevented from thermal deformation (thermal expansion) as a whole, thereby restraining enlargement of the orifice 34.

Moreover, the heat insulating layer 6 may be formed on the gradually reducing inner diameter portion 33, e.g., by spraying a molten constituent material of the heat insulating layer 6 on the gradually reducing inner diameter portion 33 (the inner circumferential surface 332 of the first member 4) by a thermal spray method and solidifying the constituent material thus sprayed, although not particularly limited thereto.

As an alternative for the spraying by use of the thermal spray method, a metal cover having nearly the same shape as that of the gradually reducing inner diameter portion 33, i.e., a pipe-like shape, may be arranged on the gradually reducing inner diameter portion 33 with a space (clearance) left therebetween. It may also be possible to arrange a metal cover coated with ceramics on the gradually reducing inner diameter portion 33. The metal cover coated with ceramics may be called an insulating member.

Second Embodiment

Figure 3:
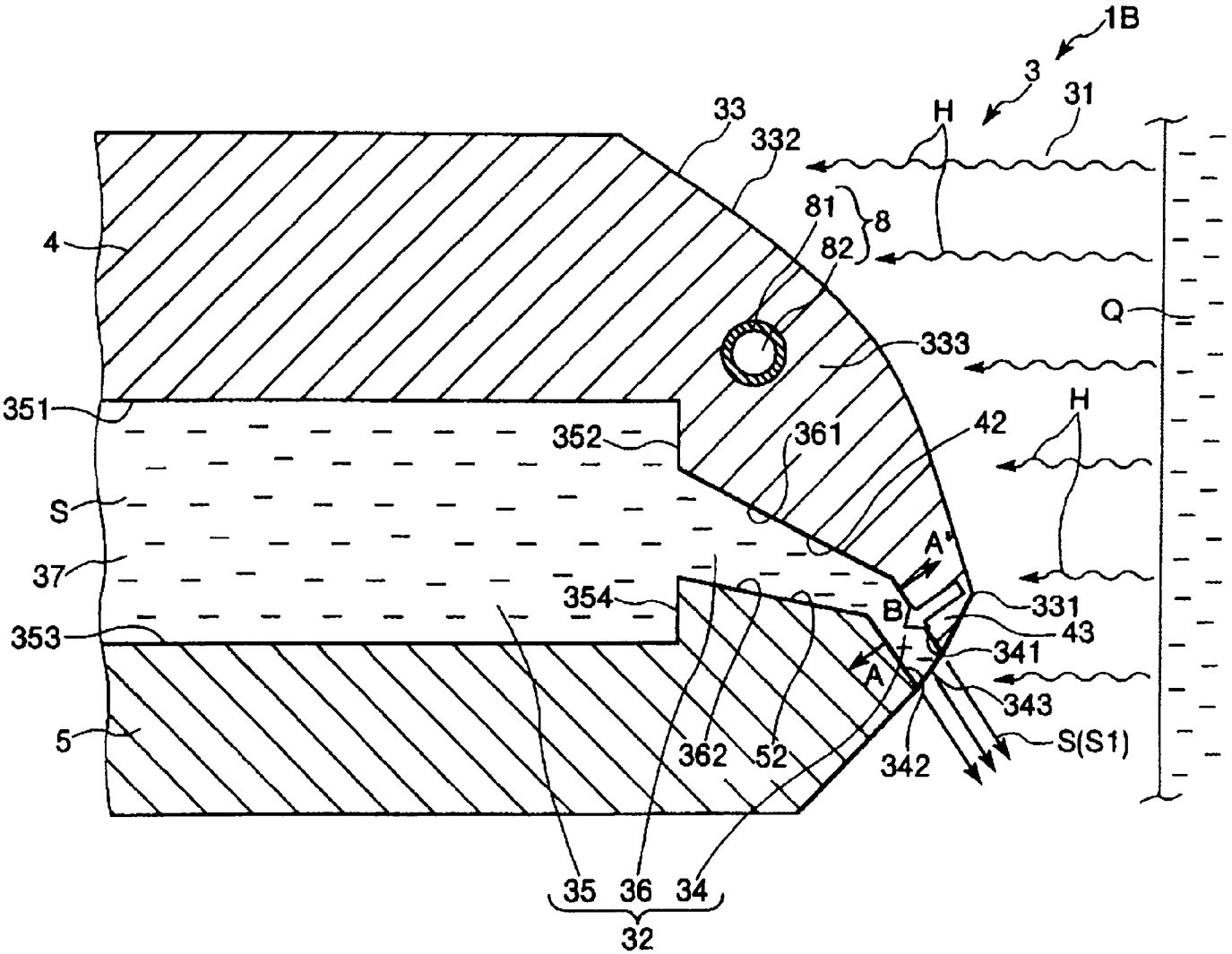
FIG. 3 is a vertical sectional view showing a metal powder production apparatus in accordance with a second embodiment of the present invention.

FIG. 3 is a vertical sectional view showing a metal powder production apparatus in accordance with a second embodiment of the present invention.

In the following description, the upper side in FIG. 3 will be referred to as "top" or "upper" and the lower side will be referred to as "bottom" or "lower", only for the sake of better understanding.

Hereinafter, a metal powder production apparatus in accordance with a second embodiment of the present invention will be described with reference to this figure. The following description will be centered on the points differing from the foregoing embodiments, with the same points omitted from description.

The present embodiment is essentially the same as the first embodiment, except that a cooling means is provided in the first member 4 instead of the heat insulating layer 6 as a heat insulating means.

Embedded in the region 333 of the first member 4 of the metal powder production apparatus 1B shown in FIG. 3 is a cooling means 8 for cooling the region 333 of the first member 4.

The cooling means 8 includes a tubular body 81 of an annular shape extending in the circumferential direction of the gradually reducing inner diameter portion 33 and a coolant 82 filled in the tubular body 81.

With the metal powder production apparatus 1B of the configuration noted above, the region 333 of the first member 4 is cooled down under the action of the cooling means 8 and is prevented from thermal deformation. For this reason, just like the metal powder production apparatus 1A of the first embodiment, the region 43 of the first member 4 absorbs the radiant heat H of the molten metal Q.

Thus, the region 43 of the first member 4 is preferentially or selectively displaced (thermally deformed) in such a direction as to reduce the size of the orifice 34, i.e., in the direction indicated by an arrow "B" in FIG. 3. The displacement of the region 43 of the first member 4 in the arrow "B" direction is cancelled by the displacement of the outer circumferential surface 342 in the arrow "A'" direction in FIG. 3, thereby restraining enlargement of the orifice 34.

Thus, it is possible to maintain the size of the orifice 34 constant, whereby the flow velocity of the water S injected from the orifice 34 can be kept constant in a reliable manner.

As shown in FIG. 3, it is preferred that the cooling means 8 is positioned above the introduction path 36. This ensures that the cooling means 8 is sufficiently spaced apart from the region 43 of the first member 4, thereby reliably preventing the region 43 of the first member 4 from being cooled down by the cooling means 8.

Although the cooling means 8 is adapted to cool only the first member 4 in the present embodiment, the present invention is not limited thereto. The second member 5 may also be cooled down in a similar manner. In case the cooling means 8 cools down the second member 5, it becomes possible to restrain thermal expansion of the second member 5.

Although the cooling means 8 is provided in the first member 4, the present invention is not limited thereto. For example, the cooling means 8 may be provided in the second member 5.

It is preferred that the coolant 82 is forcibly circulated in the cooling means 8. This makes it possible to restrain thermal expansion of the nozzle 3 as a whole.

Although the number of the tubular body 81 is singular in the configuration shown in FIG. 3, the present invention is not limited thereto. A plurality of tubular bodies may be employed alternatively.

Examples of the coolant 82 include, but are not particularly limited to, water and polyethylene glycol.

Although the cooling means 8 is comprised of the tubular body 81 and the coolant 82 in the configuration shown in FIG. 3, the present invention is not limited thereto. For example, the cooling means 8 may be of the type having a Peltier device.

While the metal powder production apparatus of the present invention has been described hereinabove in respect of the illustrated embodiments, the present invention is not limited thereto. Individual parts constituting the metal powder production apparatus may be substituted by other arbitrary ones capable of performing like functions. Moreover, arbitrary constituent parts may be added if necessary.

In addition, although the liquid (fluid) injected from the nozzle is water in the foregoing embodiments, the present invention is not limited thereto. The liquid may be, e.g., lipids or solvents.

What is claimed is:

1. A metal powder production apparatus comprising:

a supply part for supplying molten metal; and a nozzle provided below the supply part, the nozzle including a flow path defined by an inner circumferential surface of the nozzle through which the molten metal supplied from the supply part can pass, the inner circumferential surface of the nozzle having a gradually reducing inner diameter portion whose inner diameter is gradually reduced in a downward direction, an orifice opened at a bottom end of the flow path and adapted to inject fluid toward the flow path, a retention portion for temporarily retaining the fluid, and an introduction path for introducing the fluid from the retention portion to the orifice, the nozzle including a first member having the gradually reducing inner diameter portion and a second member provided below the first member with a space left between the first member and the second member, wherein the orifice, the retention portion and the introduction path are defined by the first member and the second member, whereby the molten metal is dispersed and turned into a multiplicity of fine liquid droplets by bringing the molten metal passing through the flow path into contact with the fluid injected from the orifice of the nozzle, so that the multiplicity of fine liquid droplets are solidified to thereby produce metal powder, wherein the metal powder production apparatus further comprises a heat insulating means for cutting off radiant heat emitted from the molten metal passing through the flow path, the heat insulating means being provided on or in the first member so that the gradually reducing inner diameter portion is prevented, under an action of the heat insulating means, from being thermally deformed by the radiant heat of the molten metal but a region of the first member near the orifice is thermally deformed in such a direction as to reduce a size of the orifice by absorbing the radiant heat of the molten metal, whereby the orifice can be restrained from being enlarged by the pressure of the fluid passing through the orifice.

2. The metal powder production apparatus as claimed in claim 1, wherein the heat insulating means includes a heat insulating layer for cutting off radiant heat emitted from the molten metal passing through the flow path, the heat insulating layer formed on the gradually reducing inner diameter portion of the first member.

3. The metal powder production apparatus as claimed in claim 2, wherein the heat insulating layer is mainly composed of ceramics.

4. The metal powder production apparatus as claimed in claim 1, wherein the heat insulating means includes a pipe-shaped heat insulating member for cutting off radiant heat emitted from the molten metal passing through the flow path, the heat insulating member provided at the inner side of the gradually reducing inner diameter portion of the first member.

5. The metal powder production apparatus as claimed in claim 1, wherein the heat insulating means includes a cooling means for cooling down a region of the first member which excludes a region of the first member adjacent to the opening of the orifice.

6. The metal powder production apparatus as claimed in claim 5, wherein the cooling means is embedded in the first member.

7. The metal powder production apparatus as claimed in claim 5, wherein the cooling means is positioned above the introduction path.

8. The metal powder production apparatus as claimed in claim 1, wherein the orifice is opened in a circumferential slit shape extending over the inner circumferential surface of the nozzle.

9. The metal powder production apparatus as claimed in claim 8, wherein the orifice is configured to ensure that the fluid is injected in a generally conical contour with an apex lying at a lower side.

10. The metal powder production apparatus as claimed in claim 9, wherein the orifice has an inner circumferential surface defined by the first member and an outer circumferential surface defined by the second member.

11. The metal powder production apparatus as claimed in claim 1, wherein the introduction path has a vertical cross-section of a wedge shape.

12. The metal powder production apparatus as claimed in claim 1, wherein the gradually reducing inner diameter portion is of a convergent shape.

* * * * *